US008228278B2

(12) United States Patent
Hsu et al.

(10) Patent No.: US 8,228,278 B2
(45) Date of Patent: Jul. 24, 2012

(54) DISPLAY PANEL

(75) Inventors: Chao-Hui Hsu, Taoyuan County (TW); Sheh-Cha Cho, Tainan (TW); Yuan-Yi Laio, Taipei County (TW); Cheng-Ping Chen, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 811 days.

(21) Appl. No.: 12/369,745

(22) Filed: Feb. 12, 2009

(65) Prior Publication Data

US 2010/0053053 A1 Mar. 4, 2010

(30) Foreign Application Priority Data

Aug. 28, 2008 (TW) ..... 97132999 A

(51) Int. Cl.
*G09G 3/36* (2006.01)

(52) U.S. Cl. ..... 345/92; 345/87; 345/95

(58) Field of Classification Search ..... 345/76
See application file for complete search history.

(56) References Cited

U.S. PATENT DOCUMENTS

2005/0104530 A1* 5/2005 Chung et al. ..... 315/169.3
2009/0244420 A1* 10/2009 Chung et al. ..... 349/40

FOREIGN PATENT DOCUMENTS

TW 200719313 5/2007

* cited by examiner

*Primary Examiner* — Joseph Haley
*Assistant Examiner* — Nicholas Lee
(74) *Attorney, Agent, or Firm* — Jianq Chyun IP Office

(57) ABSTRACT

A display panel has a display area and a peripheral circuit area next to the display area. The display panel includes a number of pixels, a first signal line, a second signal line, and a third signal line. The pixels are arranged in array in the display area. The first signal line disposed in an intersection of the display area and the peripheral circuit area is electrically connected to the pixels. A data signal is suitable for being applied to the first signal line. The second signal line is disposed in the peripheral circuit area. A common signal is suitable for being applied to the second signal line. The third signal line is disposed between the first signal line and the second signal line. A reference signal is suitable for being applied to the third signal line. The data signal, the common signal, and the reference signal are different signals.

7 Claims, 4 Drawing Sheets

DISPLAY PANEL

CROSS-REFERENCE TO RELATED APPLICATION

This application claims the priority benefit of Taiwan application serial no. 97132999, filed Aug. 28, 2008. The entirety of the above-mentioned patent application is hereby incorporated by reference herein and made a part of specification.

BACKGROUND OF THE INVENTION

1. Field of the Invention

The present invention generally relates to a display panel, and more particularly, to a display panel capable of reducing noise in an effective manner.

2. Description of Related Art

Rapid development of multimedia technologies mostly benefits from a tremendous progress in semiconductor devices or display apparatuses. Among displays, thin film transistor liquid crystal displays (TFT-LCDs) characterized by high definition, efficient space utilization, low power consumption and no radiation have gradually become mainstream products in the display market.

At this current stage, normal medium or small-sized TFT-LCDs are frequently driven by applying AC mode common voltages, e.g., employing a line inversion display technique. Namely, AC common voltages are applied to common electrodes in the medium or small-sized TFT-LCDs. By contrast, large-sized TFT-LCDs are usually driven by applying DC mode common voltages, e.g., employing a dot inversion display technique. In other words, DC common voltages are applied to common electrodes in the large-sized TFT-LCDs.

FIG. 1A is a schematic top view of a conventional medium or small-sized display panel. FIG. 1B is a time sequence diagram illustrating driving signals of the conventional display panel depicted in FIG. 1A. Referring to FIG. 1A, a display panel 100 has a display area AA and a peripheral circuit area PA disposed around the display area AA. The display panel 100 includes a plurality of pixels 110, a data signal line 120, and a common signal line 130. The data signal line 120 is electrically connected to the pixels 110 and is disposed in an intersection of the peripheral circuit area PA and the display area AA. The common signal line 130 is disposed in the peripheral circuit area PA.

Referring to FIGS. 1A and 1B, when the display panel 100 performs a display function, a DC signal $V_{120}$ is applied to the data signal line, and an AC signal $V_{130}$ is applied to the common signal line 130 for the pixels 110 to perform the display function. A voltage value of the DC signal $V_{120}$ is generally less than a minimum voltage value of the AC signal $V_{130}$. No other metal layers are disposed between the data signal line 120 and the common signal line 130, and the data signal line 120 and the common signal line 130 are in the same conductive layer. Therefore, a signal of the data signal line 120 and a signal of the common signal line 130 interfere with each other, thereby giving rise to variations in an electric field to a certain degree.

The variations in the electric field generated between the data signal line 120 and the common signal line 130 provide a specific acting force for resonating the two metal conductors. Once a vibration frequency generated between the data signal line 120 and the common signal line 130 falls within a frequency range that can be heard by human ear, the display panel 100 produces the noise that discomforts users. Specifically, as a differential value between the AC signal $V_{130}$ and the DC signal $V_{120}$ increases, the resonance and the noise increase as well.

SUMMARY OF THE INVENTION

Accordingly, the present invention is directed to a display panel for reducing noise produced by a conventional display panel.

In the present invention, a display panel having a display area and a peripheral circuit area is provided. The peripheral circuit area is disposed around the display area. Besides, the display panel includes a plurality of pixels, a first signal line, a second signal line, and a third signal line. The pixels are arranged in array in the display area. The first signal line is disposed in an intersection of the display area and the peripheral circuit area and is electrically connected to the pixels. A data signal is suitable for being applied to the first signal line. The second signal line is disposed in the peripheral circuit area, and a common signal is suitable for being applied to the second signal line. The third signal line is disposed between the first signal line and the second signal line, and a reference signal is suitable for being applied to the third signal line. The data signal, the common signal, and the reference signal are different.

In an embodiment of the present invention, a distance between the first signal line and the third signal line can be shorter than a distance between the second signal line and the third signal line.

In an embodiment of the present invention, the common signal includes a positive half-circle signal and a negative half-circle signal which are continuously and alternately applied to the second signal line. The reference signal is, for example, a constant signal, and a voltage value of the constant signal is less than or equal to a voltage value of the positive half-circle signal and is greater than or equal to a voltage value of the negative half-circle signal. In addition, the reference signal can also include a DC offset level, a first pulse level, and a second pulse level that are input alternately. Here, the DC offset level, the first pulse level, and the second pulse level are different. Moreover, a pulse time of the first pulse level is overlapped with and less than a cycle time of the positive half-circle signal, and a pulse time of the second pulse level is overlapped with and less than a cycle time of the negative half-circle signal. In practice, the pulse time of the first pulse level is, for example, half of the cycle time of the positive half-circle signal, and the pulse time of the second pulse level is, for example, half of the cycle time of the negative half-circle signal. It is certain that the pulse time of the first pulse level can also be one-third of the cycle time of the positive half-circle signal, and the pulse time of the second pulse level can also be one-third of the cycle time of the negative half-circle signal.

In an embodiment of the present invention, the data signal is a DC signal, and a voltage value of the DC signal is less than a minimum voltage value of the common signal.

In an embodiment of the present invention, the second signal line is in a U shape. Meanwhile, the third signal line is also in the U shape, for example.

In an embodiment of the present invention, the second signal line is in an L shape. Meanwhile, the third signal line is also in the L shape, for example.

According to the present invention, the third signal line is disposed between the first signal line and the second signal line, and the signals of the third signal line interfere with the resonance between the first signal line and the second signal line. As such, the issue regarding the resonance between the metal layers of the display panel can be resolved in the present invention, such that noise is not apt to occur.

To make the above and other features and advantages of the present invention more comprehensible, embodiments accompanied with figures are detailed as follows.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1A:
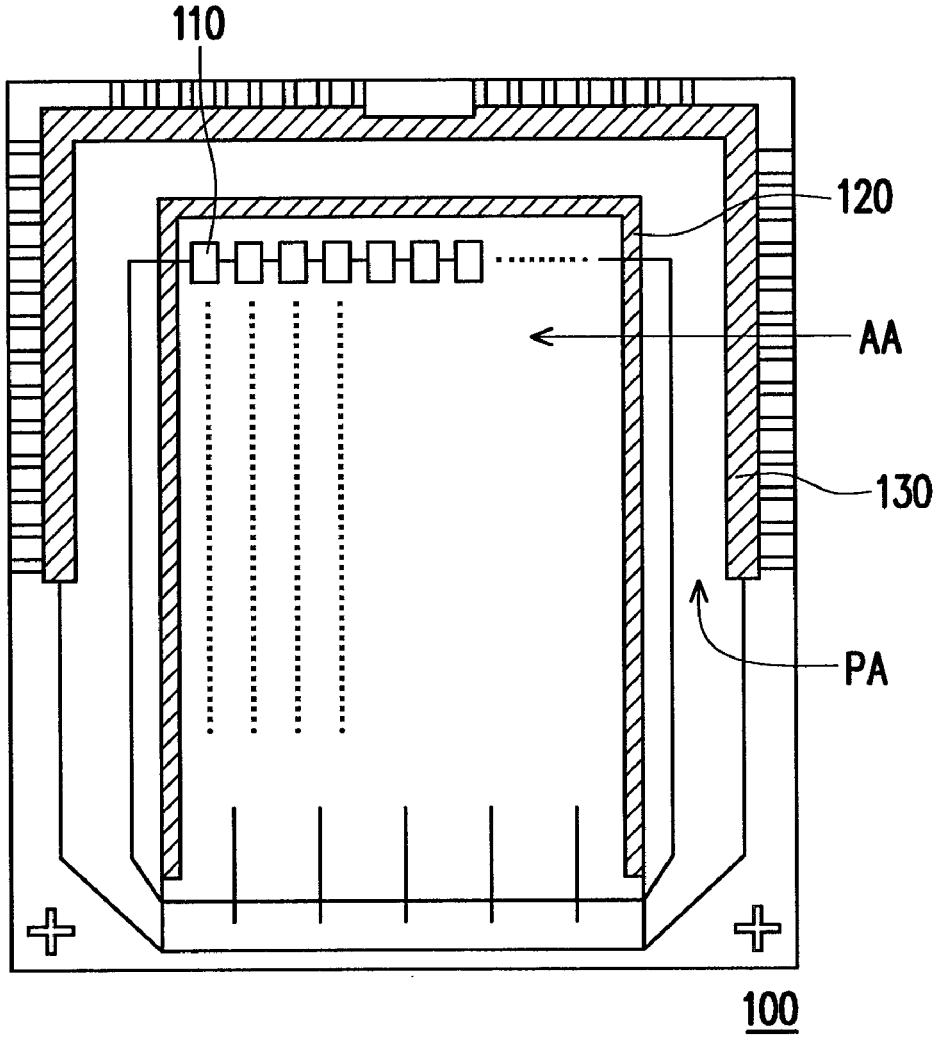
FIG. 1A(PRIOR ART)
FIG. 1A is a schematic top view of a conventional medium or small-sized display panel.
Figure 1B:
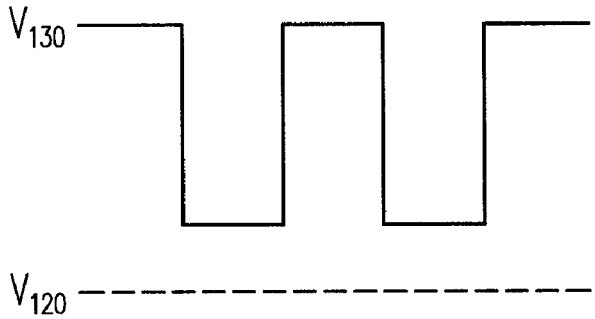
FIG. 1B(PRIOR ART)
FIG. 1B is a time sequence diagram illustrating driving signals of the conventional display panel depicted in FIG. 1A.
Figure 2:
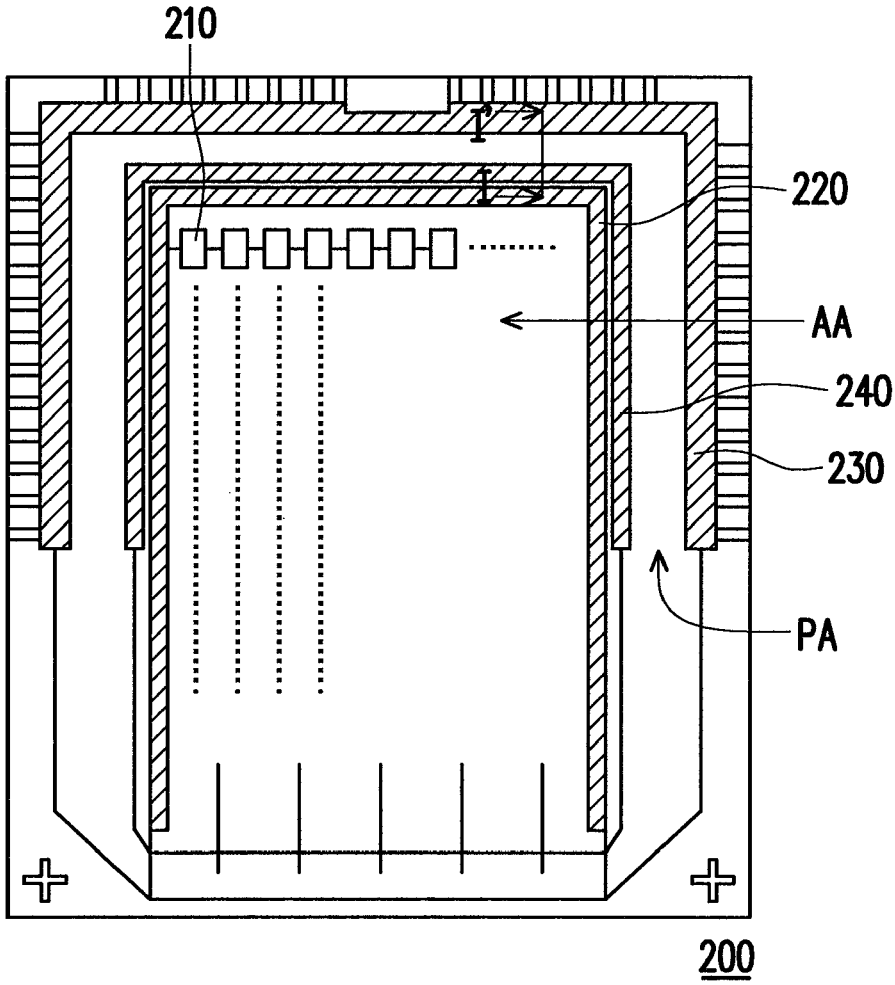
FIG. 2 illustrates a display panel according to an embodiment of the present invention.
Figure 3:
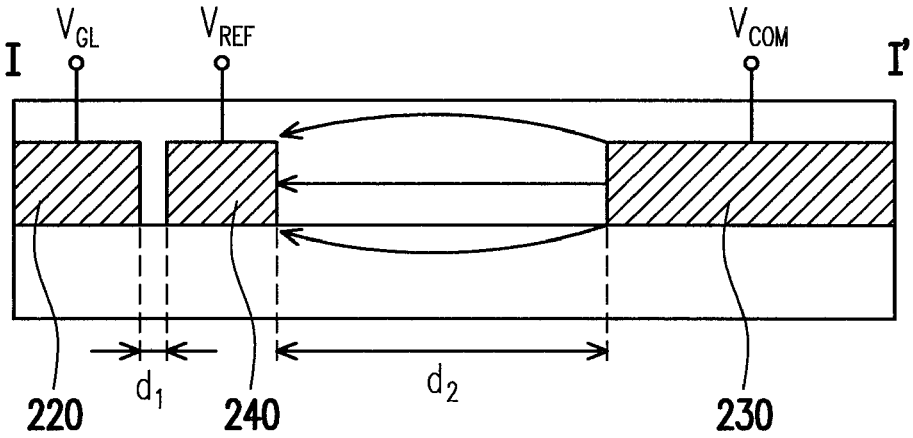
FIG. 3 is a cross-sectional view taken along a section line I-I' depicted in FIG. 2.

FIG. 2 illustrates a display panel according to an embodiment of the present invention. FIG. 3 is a cross-sectional view taken along a section line I-I' depicted in FIG. 2. Referring to FIG. 2, a display panel 200 has a display area AA and a peripheral circuit area PA. The peripheral circuit area PA is disposed around the display area AA. Besides, the display panel 200 includes a plurality of pixels 210, a first signal line 220, a second signal line 230, and a third signal line 240. The pixels 210 are arranged in array in the display area AA. The first signal line 220 is disposed in an intersection of the display area AA and the peripheral circuit area PA, and is electrically connected to the pixels 210. The second signal line 230 is disposed in the peripheral circuit area PA, and the third signal line 240 is disposed between the first signal line 220 and the second signal line 230.

Referring to FIGS. 2 and 3, the first signal line 220, the second signal line 230, and the third signal line 240 are substantially conductive circuits disposed on the same plane. In addition, the first signal line 220, the second signal line 230, and the third signal line 240 are arranged on an insulation substrate and are covered by an insulation layer, for example. That is to say, the first signal line 220, the second signal line 230, and the third signal line 240 are separated by the insulation layer. Since the first signal line 220, the second signal line 230, and the third signal line 240 are individual conductive circuits, signals of the first signal line 220, the second signal line 230, and the third signal line 240 may interfere with one another, thereby giving rise to variations in an electric field to a certain degree. As a matter of fact, a data signal $V_{GL}$ is suitable for being applied to the first signal line 220, a common signal $V_{COM}$ is suitable for being applied to the second signal line 230, and a reference signal $V_{REF}$ is suitable for being applied to the third signal line 240. Here, the data signal $V_{GL}$, the common signal $V_{COM}$, and the reference signal $V_{REF}$ are different signals.

For instance, in a medium or small-sized display panel, the data signal $V_{GL}$ is a DC signal, while the common signal $V_{COM}$ is an AC signal. Meanwhile, a voltage value of the data signal $V_{GL}$ is constantly less than a minimum voltage value of the common signal $V_{COM}$. When the first signal line 220 is adjacent to the second signal line 230, variations in an electric field between the first signal line 220 and the second signal line 230 would occur periodically, and thereby noise that discomforts users is produced. Moreover, the difference between the first signal line 220 and the second signal line 230 is relatively large and further enhances the noise. Note that the first signal line 220 and the second signal line 230 are signal transmission lines required by the display panel 200 for performing a display function, and therefore the signals of the first signal line 220 and the second signal line 230 cannot be arbitrarily adjusted or changed. Once the resonance between the first signal line 220 and the second signal line 230 leads to the production of the noise, it is unlikely to remedy said defect.

As such, the third signal line 240 to which the reference signal $V_{REF}$ is applied is disposed between the first signal line 220 and the second signal line 230 according to the present embodiment, so as to adjust the resonance between the adjacent conductive circuits. Since the reference signal $V_{REF}$ is not required by the display panel 200 for performing the display function, the reference signal $V_{REF}$ is able to be modified based on different conditions and demands. In other words, the defect in connection with the production of the noise in the display panel 200 can be overcome by disposing the third signal line 240 between the first signal line 220 and the second signal line 230 and by adjusting the reference signal $V_{REF}$ applied to the third signal line 240 according to the present embodiment. A way to resolve the issue regarding the noise is elaborated hereinafter by describing the relationship between the common signal $V_{COM}$ and the reference signal $V_{REF}$.

Figure 4A:
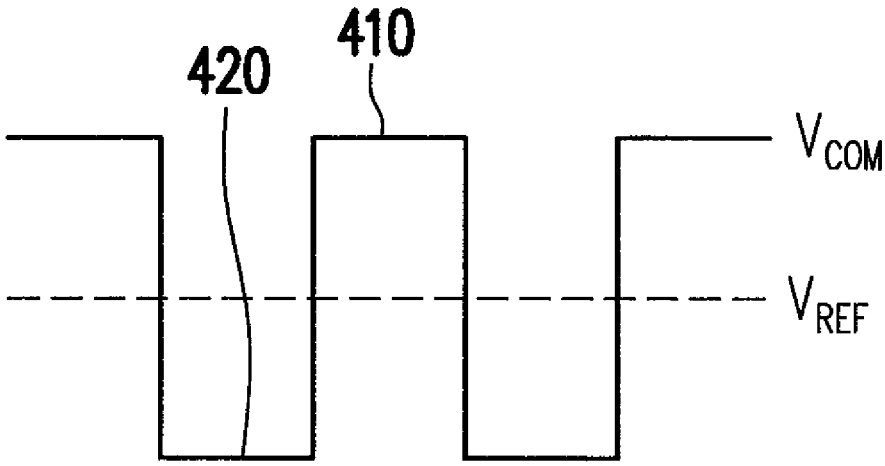
FIGS. 4A through 4D are schematic views illustrating time sequence relationship between various common signals and reference signals according to the present invention.

FIGS. 4A through 4D are schematic views illustrating time sequence relationship between various common signals and reference signals according to the present invention. Referring to FIGS. 3 and 4A, the common signal $V_{COM}$ includes a positive half-circle signal 410 and a negative half-circle signal 420 that are continuously and alternately applied to the second signal line 230. In other words, the common signal $V_{COM}$ is an AC signal that rises and falls alternately. Besides, the reference signal $V_{REF}$ is, for example, a constant signal, and a voltage value of the constant signal is, for example, an average voltage value of the positive half-circle signal 410 and the negative half-circle signal 420. Under the design of the signals of the present embodiment, the third signal line 240 can be disposed next to the first signal line 220. Namely, a distance d1 between the first signal line 220 and the third signal line 240 can be shorter than a distance d2 between the second signal line 230 and the third signal line 240.

If the first signal line 220 is rather close to the third signal line 240, the resonance generated between the third signal line 240 and the second signal line 230 would be similar to the resonance generated between the first signal line 220 and the second signal line 230. Nonetheless, the voltage difference between the second signal line 230 and the third signal line 240 is approximately half of the voltage difference between the positive half-circle signal 410 and the negative half-circle signal 420. Thereby, the voltage difference between the second signal line 230 and the third signal line 240 is varied to a less extent than the voltage difference between the first signal line 220 and the second signal line 230. That is to say, due to the relatively small resonance amplitude generated between the second signal line 230 and the third signal line 240, the noise becomes less apt to be heard by human ear. In short, an appropriate shielding effect provided by the third signal line 240 is conducive to a reduction of the noise effectively.

Certainly, the voltage value of the reference signal $V_{REF}$ is not limited to that mentioned in the present embodiment.

Figure 4B:
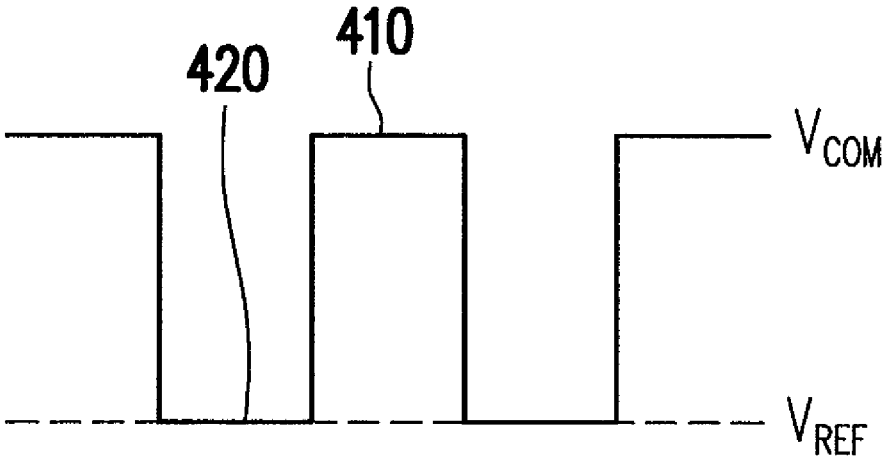

Namely, the voltage value of the reference signal $V_{REF}$ can be substantially less than or equal to a voltage value of the positive half-circle signal 410 and is greater than or equal to a voltage value of the negative half-circle signal 420. For instance, the voltage value of the reference signal $V_{REF}$ can be equal to the voltage value of the negative half-circle signal 420 as shown in FIG. 4B. Unquestionably, the voltage value of the reference signal $V_{REF}$ can also be equal to the voltage value of the positive half-circle signal 410 or can fall within a range between the voltage value of the positive half-circle signal 410 and the voltage value of the negative half-circle signal 420. The constant reference signal $V_{REF}$ leads to the appropriate shielding effect by which the resonance between the adjacent conductive circuits can be reduced. As such, the unpleasant noise is not apt to occur.

Figure 4C:
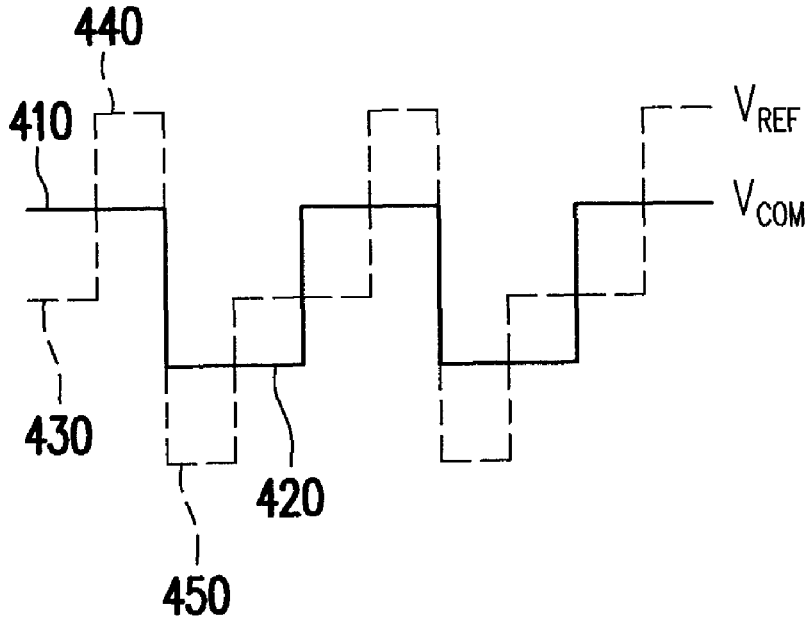
Figure 4D:
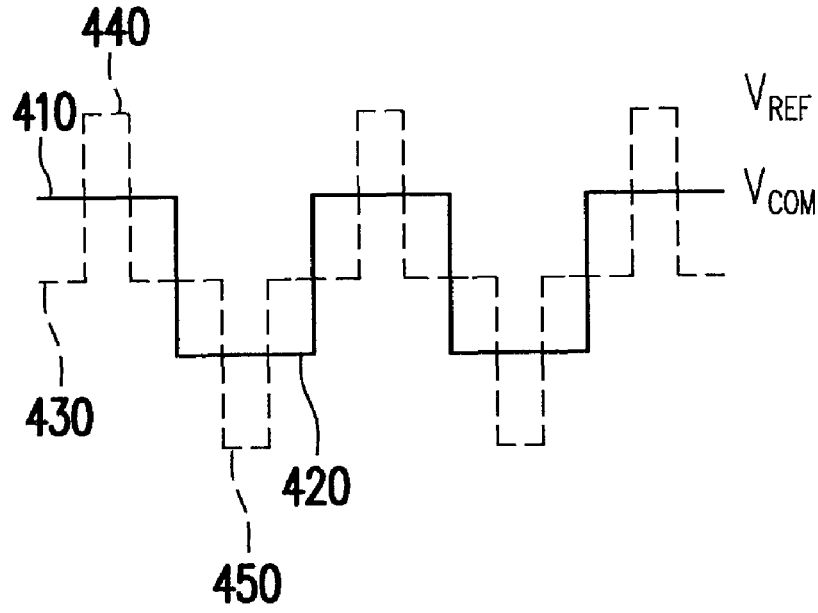

On the other hand, the reference signal $V_{REF}$ can also be designed in an AC mode. Referring to FIG. 4C, the reference signal $V_{REF}$ includes a DC offset level 430, a first pulse level 440, and a second pulse level 450 that are alternately input. Here, the DC offset level 430, the first pulse level 440, and the second pulse level 450 respectively have different voltage values. Moreover, a pulse time of the first pulse level 440 is overlapped with and less than a cycle time of the positive half-circle signal 410, and a pulse time of the second pulse level 450 is overlapped with and less than a cycle time of the negative half-circle signal 420. In practice, as shown in FIG. 4C, the pulse time of the first pulse level 440 is, for example, half of the cycle time of the positive half-circle signal 410, and the pulse time of the second pulse level 450 is, for example, half of the cycle time of the negative half-circle signal 420. Certainly, as shown in FIG. 4D, the pulse time of the first pulse level 440 can also be one-third of the cycle time of the positive half-circle signal 410, and the pulse time of the second pulse level 450 can also be one-third of the cycle time of the negative half-circle signal 420.

The first pulse level 440 and the second pulse level 450 of the reference signal $V_{REF}$ both have the pulse time less than the cycle time of the positive half-circle signal 410 and the cycle time of the negative half-circle signal 420. Hence, the variations in the electric field between the second signal line 230 and the third signal line 240 occur more frequently due to the interference between the reference signal $V_{REF}$ and the common signal $V_{COM}$. In the meantime, the resonance frequency generated between the second signal line 230 and the third signal line 240 is raised correspondingly. When the resonance frequency generated between the second signal line 230 and the third signal line 240 exceeds a frequency range that can be heard by human ear, the display panel 200 would not produce the noise that discomforts users.

In general, the voltage value of the reference signal $V_{REF}$ can be adjusted in the present embodiment, so as to reduce the amplitude of the variations in the electric field between the second signal line 230 and the third signal line 240. The resonance between the second signal line 230 and the third signal line 240 is then decreased, so as to reduce the volume of the noise. On the other hand, the reference signal $V_{REF}$ can also be designed upon the difference between the pulse time of the common signal $V_{COM}$ and the pulse time of the reference signal $V_{REF}$, such that the resonance frequency between the second signal line 230 and the third signal line 240 can be adjusted. As long as the resonance frequency generated between the second signal line 230 and the third signal line 240 exceeds the frequency range that can be heard by human ear, the noise would not be produced.

After that, referring to FIG. 2, to reduce or eliminate the noise of the display panel 200 by means of the appropriate shielding effect or the interference caused by the third signal line 240, the third signal line 240 is preferably in a shape similar to that of the second signal line 230. For instance, the second signal line 230 is in a U shape according to the present embodiment, and so is the third signal line 240. In another embodiment, the second signal line 230 can be in an L shape, and so can be the third signal line 240. It is certain that the second signal line 230 and the third signal line 240 can be shaped differently. As long as the third signal line 240 is disposed between the first signal line 220 and the second signal line 230, the issue regarding the noise can be resolved.

In light of the foregoing, the third signal line to which the reference signal can be applied upon different demands is additionally disposed in the peripheral circuits of the conventional display panel according to the present invention. Through the shielding effect or the interference caused by the reference signal that is applied to the third signal line, the resonance between the adjacent conductive circuits in the display panel can be affected. Thereby, the resonance between the adjacent conductive circuits in the peripheral circuit area of the display panel would not result in the production of the noise, and the users would feel more comfortable during the operation of the display panel of the present invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, having a display area and a peripheral circuit area disposed around the display area, the display panel comprising:

a plurality of pixels, arranged in array in the display area;

a first signal line, disposed in an intersection of the display area and the peripheral circuit area and electrically connected to the pixels, wherein a data signal is suitable for being applied to the first signal line;

a second signal line, disposed in the peripheral circuit area, wherein a common signal is suitable for being applied to the second signal line, wherein the common signal comprises a positive half-cycle signal and a negative half-cycle signal, and the positive half-cycle signal and the negative half-cycle signal are continuously and alternately applied to the second signal line; and a third signal line, disposed between the first signal line and the second signal line, wherein a reference signal is suitable for being applied to the third signal line, and the data signal, the common signal, and the reference signal are different, and the reference signal comprises a DC offset level, a first pulse level, and a second pulse level, the DC offset level, the first pulse level, and the second pulse level are different and are alternately input, a pulse time of the first ulse level is overlapped with and less than a cycle time of the positive half-cycle signal, and a pulse time of the second pulse level is overlapped with and less than a cycle time of the negative half-cycle signal.

2. The display panel as claimed in claim 1, wherein a distance between the first signal line and the third signal line is shorter than a distance between the second signal line and the third signal line.

3. The display panel as claimed in claim 1, wherein the pulse time of the first pulse level is half of the cycle time of the positive half-cycle signal, and the pulse time of the second pulse level is half of the cycle time of the negative half-cycle signal.

4. The display panel as claimed in claim 1, wherein the pulse time of the first pulse level is one-third of the cycle time of the positive half-cycle signal, and the pulse time of the second pulse level is one-third of the cycle time of the negative half-cycle signal.

5. The display panel as claimed in claim 1, wherein the data signal is a DC signal, and a voltage value of the DC signal is less than a minimum voltage value of the common signal.

6. The display panel as claimed in claim 1, wherein the second signal line is in a U shape.

7. The display panel as claimed in claim 6, wherein the third signal line is in the U shape.

* * * * *